US005617666A

United States Patent [19]

Scott

[11] Patent Number: 5,617,666

[45] Date of Patent: Apr. 8, 1997

[54] FIREARM REST

[76] Inventor: Dewey L. Scott, 4708 Black Hawk Dr., St. Louis, Mo. 63123

[21] Appl. No.: 515,390

[22] Filed: Aug. 15, 1995

[51] Int. Cl.[6] ..... F41C 29/00

[52] U.S. Cl. ..... 42/94; 89/37.04; 211/64

[58] Field of Search ..... 89/37.04; 42/94; 211/64

[56] References Cited

U.S. PATENT DOCUMENTS

| | | | |
|---|---|---|---|
| 2,290,545 | 7/1942 | Doering | 211/64 |
| 3,827,172 | 8/1974 | Howe | 42/94 |
| 4,971,208 | 11/1990 | Reinfried, Jr. et al. | 211/64 |
| 4,972,619 | 11/1990 | Eckert | 42/94 |

OTHER PUBLICATIONS

Gander Mountain 1995 catalog, pp. 26–28, 1995.

*Primary Examiner*—Michael J. Carone
*Assistant Examiner*—Christopher K. Montgomery
*Attorney, Agent, or Firm*—Grace J. Fishel

[57] ABSTRACT

A firearm rest having a platform with mounting blocks at opposite ends and a shaft journaled in the mounting blocks and turned with an operator. A pair of links are hinged together in the middle forming a bed for resting the forward end of a gun stock. One of the ends of the joined links is hinged to one of the mounting blocks while the other end is hinged to a traveling nut that is threaded on the shaft and quickly disengagable therefrom. The height of the bed can be quickly raised or lowered by disengaging the nut from the shaft, manually moving the nut along the shaft thereby decreasing or increasing the distance between the ends of the joined links and changing the elevation of the bed. Fine adjustments can be made by rotating the operator when the nut is engaged with the shaft.

8 Claims, 3 Drawing Sheets

FIG. 1
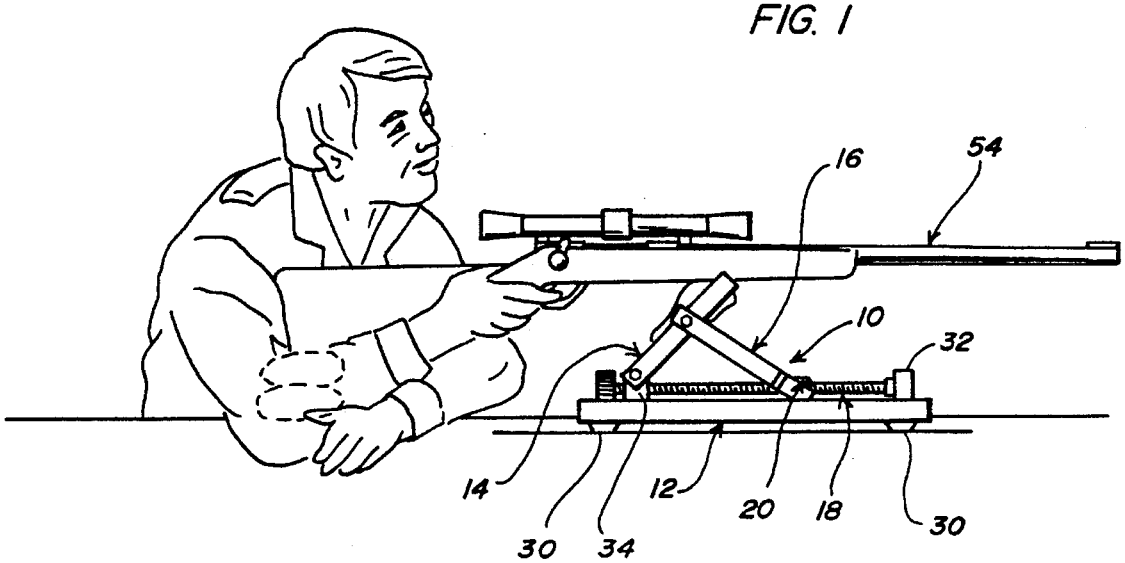
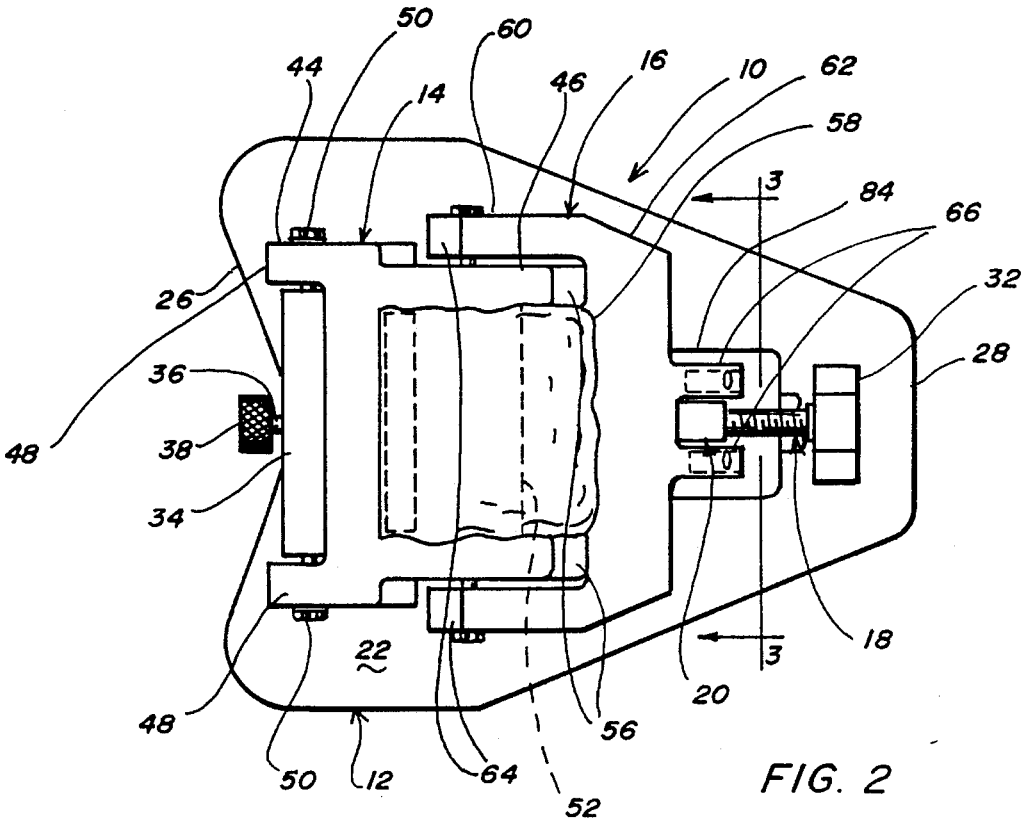
FIG. 2

FIREARM REST

BACKGROUND OF THE INVENTION

1. Field of the Invention

The present invention relates to a firearm rest, with means for fine adjustment, that folds flat and can be quickly adjusted vertically.

2. Brief Description of the Prior Art

A firearm rest is used to eliminate holding error during sighting in a gun or in target shooting with the forward end of the stock and butt of the firearm supported relative to a target to eliminate parameters of shooter error. The front rest should be adjustable vertically while the rear rest may be a sandbag or other support. There are various firearm rests on the market but none provide for quick vertical adjustment, coupled with means for fine adjustment with the added advantage of folding substantially flat for easy transporting and storage.

SUMMARY OF THE INVENTION

In view of the above, it is an object of the present invention to provide a firearm rest that can be quickly raised or lowered. It is another object to provide a firearm rest with means for fine vertical adjustment. It is also an object to provide a firearm rest that can be folded substantially flat. Other objects and features of the invention will be in part apparent and in part pointed out hereinafter.

In accordance with the invention, a firearm rest includes a platform with a forward end and a rearward end with front and rear mounting blocks. A threaded shaft is journaled in the mounting blocks with an end extending though the rear mounting block and attached to an operator for rotating the shaft in the mounting blocks. A traveling nut with a threaded bore is threaded on the shaft and is reciprocated between the mounting blocks by rotating the operator.

A first link has first and second ends with the first end hinged to the rear mounting block while the second end forms a bed for resting the forward end of a gun stock. A second link also has first and second ends with the first end hinged to the first link rearward of the first end's forward end and the second end hinged to the traveling nut. The nut is quickly disengagable from the shaft, to which end, for example, the nut has a slot intersecting the threaded bore wide enough that the nut can be selectively taken out of engagement with the shaft.

The firearm rest can be quickly raised or lowered by disengaging the nut from the shaft while fine adjustments can be made by rotating the operator. Disengagement of the nut also allows the links to fold generally flat with the platform for compact storage.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which:

FIG. 1 a side elevation of a firearm rest in accordance with the present invention in use with a rifle;

FIG. 2 is a top plan view of the firearm rest in elevated position;

DETAILED DESCRIPTION OF THE INVENTION

Figure 3:
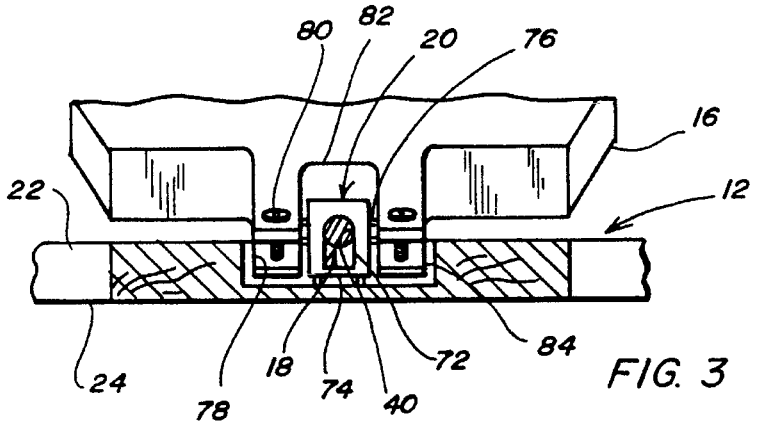
FIG. 3 is a section taken along line 3—3 in FIG. 2.

A firearm rest 10 in accordance with the present invention in major part includes a platform 12, first and second links 14, 16, respectively, a threaded shaft 18 and a traveling nut 20 associated as more particularly described hereinafter. Platform 12 has top and bottom faces 22, 24, respectively, for mounting on a bench, portable stand, etc. It can be a generally triangular plate, tapering from a rearward end 26 towards a forward end 28. In the form shown in the drawings, three feet 30 (which may be in the form of leveling legs (not shown)) are mounted on bottom face 24 under each apex for a non-slip, sturdy three-point stance.

Front and rear mounting blocks 32, 34, respectively, are attached to top face 22 at forward and rearward ends 28, 26, respectively. Shaft 18 is journaled in mounting blocks 32, 34 with an end 36 extending though the rear mounting block for attachment to an operator 38, illustrated as a knurled knob. Shaft 18 is threaded and passes through and engages a threaded bore 40 in traveling nut 20. The threads in traveling nut 20 are of the same hand as those on shaft 18 such that when shaft 18 is rotated with operator 38, traveling nut 20 reciprocates between mounting blocks 32, 34. For this to occur, traveling nut 20 must be restrained from rotating with the shaft. A bushing 42 may be provided in mounting blocks 32, 34 to minimize friction and wear.

Figure 6:
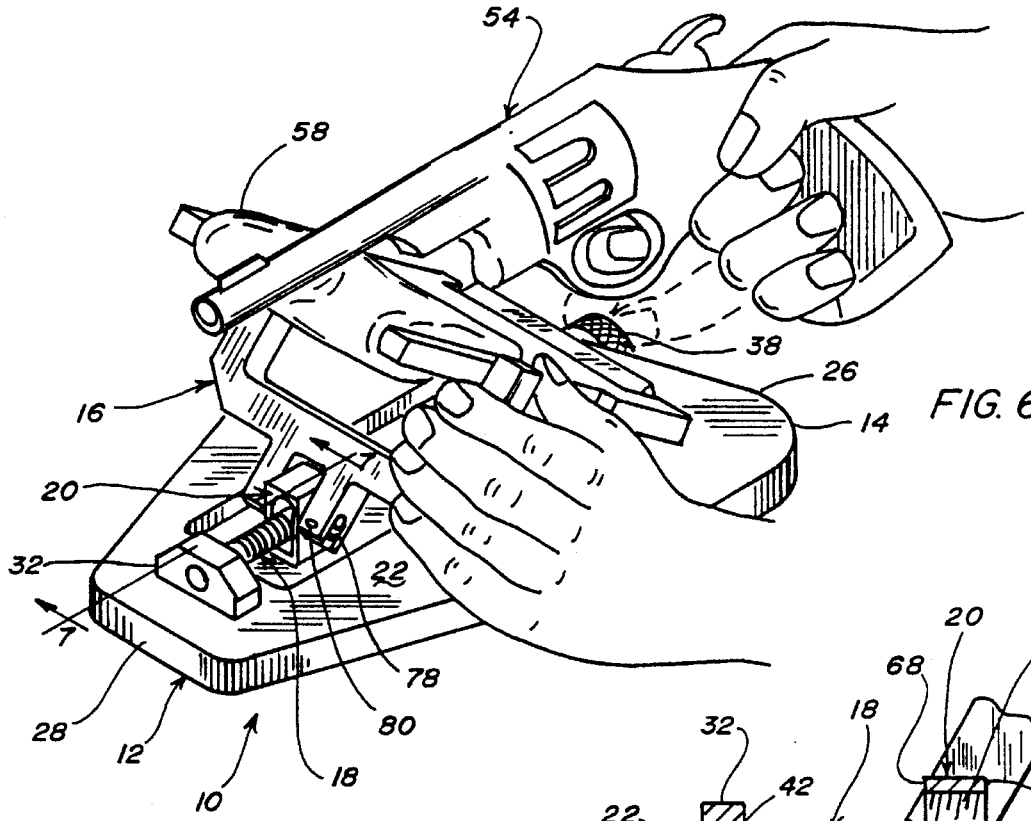
FIG. 6 a front perspective view of the firearm rest in use with a pistol.
Figure 7:
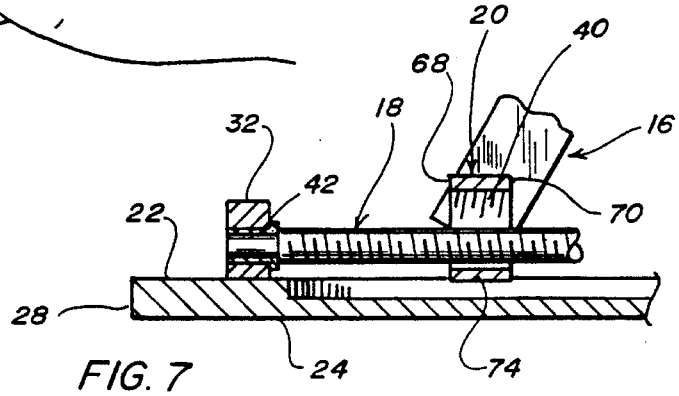
FIG. 7 is a section taken along line 7—7 in FIG. 6.

First link 14 has first and second ends 44, 46, said first end 44 hinged to rearward mounting block 34. In the form illustrated, first end is forked 48 for receipt of mounting block 34. A pair of bolts 50 (or lag screws if firearm rest 10 is made of wood) are threaded through the bifurcations of fork 48 and into the ends of mounting block 34. A bushing 42, similar to the bushings in mounting blocks 32, 34, may be provided in the bifurcations of fork 48 to minimize friction and wear. Second end 46 of first link 14 forms a bed 52 upon which a forward end of a firearm 54 such as a rifle (FIG. 1) or a pistol (FIG. 6) may be rested. Second end 46 preferably has a forked tongue 56 with a flat base padded with a rest bag 58 that is wrapped about the end of the link between the bifurcations which serve to confine firearm 54 on the bed. Rest bag 58 may be an elongated pillow, opposite ends of which are detachable attached on opposite sides of first link 14 such as with a hook and pile fastener like VELCRO. Rest bag 58 may be filled with sand or the like and serves as a rigid but conforming yoke for the firearm. Alternatively, bed 52 may be conformed to the firearm, in which case fork 48 may be Y-shaped or the like and rest bag 58 eliminated.

Second link 16 has first and second ends 60, 62, said first end 60 hinged to first link 14 rearward of the first link's forward end. First end 60 is preferably forked 64 for receipt of tongue 56 of first link. As shown in the drawings, tongue 56 is hinged medial the first and second ends of first link 14 below base. A pair of bolts 50 (or lag screws if firearm rest 10 is made of wood) are threaded through the bifurcations of fork 64 and into the sides of tongue 56. A bushing 42, similar to those discussed above, may be provided in the bifurcations of fork 64. Second end 62 of second link 16 is hinged to traveling nut 20 and may, as shown, have a forked tongue 66 within which traveling nut 20 is confined.

Traveling nut 20 is quickly disengagable from shaft 18. For example nut 20 may be split with a mechanism for bringing the halves in and out of engagement with the shaft similar to that found on a metal working lathe. In the particular form illustrated in the drawings, traveling nut 20 is a collar, illustrated (but not required) to be rectangular in shape, with forward and rearward faces 68, 70, respectively. Nut 20 is screwed internally with threaded bore 40, passing axially through forward and rearward faces 68, 70. The collar has a slot 72 intersecting bore 40 wide enough to receive shaft 18, and communicating forward and rearward faces 68, 70. Slot 72 preferably intersects bore 40 below shaft 18 so that the threads of bore 40 are held in engagement with those of shaft 18 by gravity. Slot 72 is preferably blind so that nut 20 cannot be removed from the shaft though the slot, for which purpose, a keeper 74 may be attached to nut 20 for closing slot 72. In the form illustrated, a pair of stub axles 76 are attached on opposite sides of the collar. Axles 76 are held in slots 78 formed in forked tongue 66 of second link 16 with pins 80. It will be understood, however, that nut 20 may be hinged with a pair of bolts 50 or the like, as described above.

Figure 4:
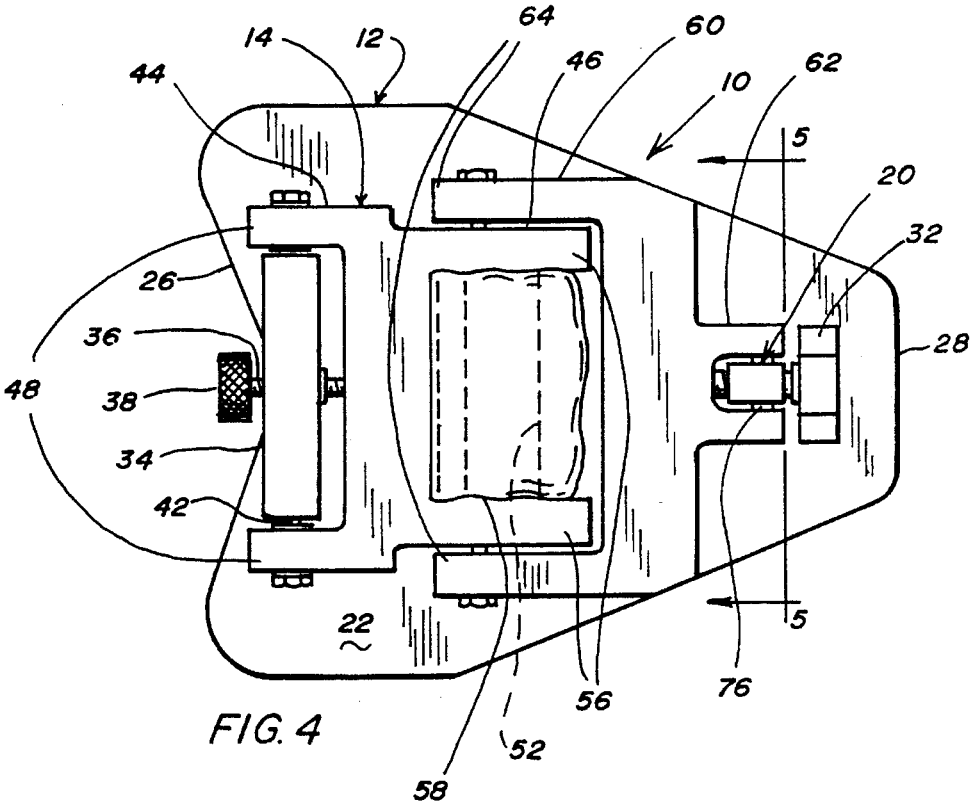
FIG. 4 is a top plan view of the firearm rest folded flat.
Figure 5:
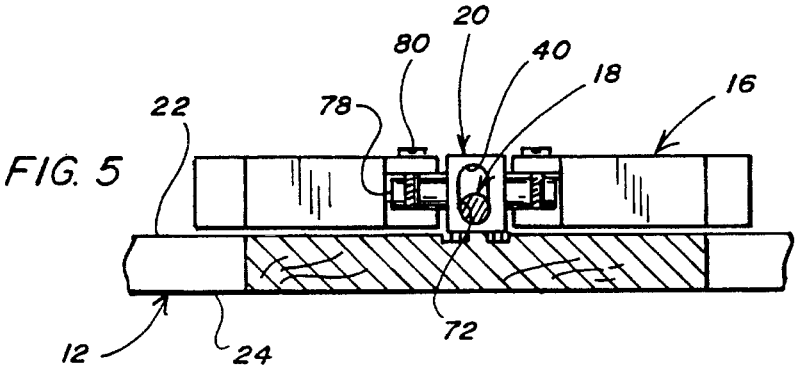
FIG. 5 is a section taken along 5—5 in FIG. 4.
Figure 8:
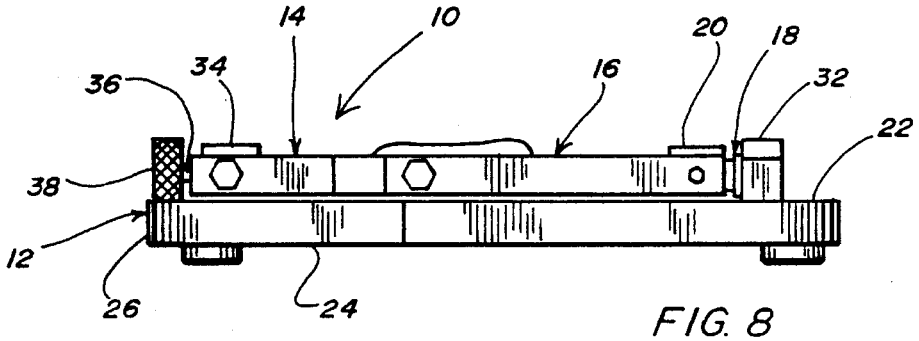
FIG. 8 is a side elevation of the firearm rest folded flat for storage.

For the purpose of folding flat as shown in FIGS. 4, 5 and 8, the space between links 14, 16 and platform 12 is made as small as possible. For this purpose, a groove 82 is provided in the underside of links 14, 16 for receipt of the top side of shaft 18 and a groove 84 is provided in top face 22 of the platform for receipt of nut 20 and tongue 66. Slot 72 has a length so that nut 20 may be lifted out of groove 84 and rested on top face 22 of the platform near forward mounting block 32. In which position, links 14, 16 rest upon the topside of shaft 18 and lie in a straight, or substantially straight line, parallel with platform 12.

In use, firearm rest 10 is quickly taken from the folded condition (FIGS. 4, 5 and 8) to erected position (1–3 and 6–7) by lifting nut 20 and moving it to a position where it will be in engagement with shaft 18. With nut 20 disengaged from shaft 18, the nut can be quickly reciprocated along the shaft, quickly raising bed 52. When bed 52 is at about the right level, nut 20 is dropped back into engagement with shaft 18, whereon fine adjustment is made by rotating the operator. Bed 52 can be quickly lowered or restored to folded condition, when desired, by lifting nut 20 out of engagement with shaft 18. No firearm rest, insofar as known, has this combination of features.

Platform 12, links 14, 16 and blocks 32, 34 may be formed of wood, metal, plastic or the like. Shaft 18, nut 20 and bolts 50 may be formed of metal or suitable plastic.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A firearm rest comprising a platform with a forward end and rearward end, front and rear mounting blocks attached to the forward and rearward end of the platform, a shaft journaled in the mounting blocks with an end extending though the rear mounting block and attached to an operator for rotating the shaft in the mounting blocks, a traveling nut with a threaded bore threaded on the shaft, said nut reciprocated between the mounting blocks by rotating the operator, a first link with first and second ends, said first end of the first link hinged to the rear mounting block, said second end of the first link forming a bed for resting a forward end of a stock of a firearm, a second link with first and second ends, said first end of the second link hinged to the first link rearward of the first end's forward end and said second end hinged to the traveling nut, said nut being quickly disengagable from the shaft, whereby the firearm rest can be quickly raised or lowered by taking the nut out of engagement with the shaft while fine adjustments can be made by rotating the operator with the nut engaged.

2. The firearm rest of claim 1 wherein the second end of the first link is forked, said fork having a flat base forming the bed.

3. The firearm rest of claim 2 wherein the bed is padded with a rest bag.

4. A firearm rest comprising a platform with a forward end and rearward end, front and rear mounting blocks attached to the forward and rearward end of the platform, a shaft journaled in the mounting blocks with an end extending though the rear mounting block and attached to an operator for rotating the shaft in the mounting blocks, a traveling nut with a threaded bore threaded on the shaft, said nut reciprocated between the mounting blocks by rotating the operator, a first link with first and second ends, said first end of the first link hinged to the rear mounting block, said second end of the first link having a forked tongue forming a bed for resting a forward end of a stock of a firearm, a second link with first and second ends, said first end of the second link forked for receipt of the forked tongue of the first link, said tongue hinged in the fork of the second link medial the first and second ends of said first link and said second end having a forked tongue in which is hinged the traveling nut, said nut having a blind slot intersecting the threaded bore, said slot wide enough that the nut can be lifted out of engagement with the shaft but closed such that the nut cannot be removed from the shaft, whereby the firearm rest can be quickly raised or lowered by lifting the nut out of engagement with the shaft while fine adjustments can be made by rotating the operator with the nut engaged.

5. The firearm rest of claim 4 wherein the platform is a plate mounted on a plurality of feet.

6. The firearm rest of claim 5 wherein the platform is grooved for receipt of the second end of the second link and wherein the first and second links are grooved on a side opposing the platform for receipt of the shaft to minimize the spacing between the platform and the links in folded condition.

7. The firearm rest of claim 6 wherein the traveling nut is mounted on two stub axles and pinned in a slot in the forked tongue of the second link.

8. The firearm rest of claim 7 wherein the bed is padded with a rest bag.

* * * * *